US005564943A

United States Patent [19]

Weiss

[11] Patent Number: 5,564,943

[45] Date of Patent: Oct. 15, 1996

[54] ELECTRIC SOCKET CONVERTOR

[76] Inventor: Alan Weiss, 244 Tolstoy La., Severna Park, Md. 21146

[21] Appl. No.: 451,492

[22] Filed: May 26, 1995

[51] Int. Cl.[6] ..... H01R 33/00

[52] U.S. Cl. ..... 439/502; 439/638; 439/639; 439/668

[58] Field of Search ..... 439/502, 504, 439/638, 639, 668

[56] References Cited

U.S. PATENT DOCUMENTS

| | | | |
|---|---|---|---|
| 2,489,037 | 11/1949 | Kailer | 439/668 |
| 2,536,355 | 1/1951 | Cox . | |
| 2,637,799 | 5/1953 | Wood . | |
| 3,593,016 | 7/1971 | Gerdel . | |
| 3,634,680 | 1/1972 | Myrah . | |
| 3,896,364 | 7/1975 | Reister . | |
| 3,967,133 | 6/1976 | Bokern . | |
| 4,248,494 | 2/1981 | McDonald . | |
| 4,261,634 | 4/1981 | Robinson | 439/668 |
| 4,622,454 | 11/1986 | Castille . | |
| 4,872,230 | 10/1989 | Levine | 439/502 |
| 4,946,396 | 8/1990 | Saitoh | 439/502 |
| 5,007,863 | 4/1991 | Xuan . | |
| 5,083,250 | 1/1992 | Malcolm . | |
| 5,135,407 | 8/1992 | Berends | 439/502 |
| 5,142,457 | 8/1992 | Wehner . | |
| 5,217,395 | 6/1993 | Bailey et al. | 439/668 |
| 5,281,158 | 1/1994 | Lin . | |
| 5,319,312 | 6/1994 | Segilia . | |
| 5,326,283 | 7/1994 | Chen | 439/502 |
| 5,355,273 | 10/1994 | Yoshizawa . | |
| 5,372,522 | 12/1994 | Hoeft . | |
| 5,431,585 | 7/1995 | Fan | 439/668 |

*Primary Examiner*—Gary E. Elkins
*Attorney, Agent, or Firm*—Levy, Zito & Grandinetti

[57] ABSTRACT

An electric socket convertor comprises a convertor plug receivable into a conventional electric light bulb socket. An electric convertor socket is connectable with a conventional electric cigarette lighter. A connecting mechanism electrically connects the convertor plug to the convertor socket, such that electric current at the conventional electric light bulb socket is conducted through the convertor plug to the convertor socket. An electric cigarette lighter is inserted into the convertor socket, and is thereby provided with a source of 12-volt D.C. Other portable electric devices similarly can be provided with 12-volt D.C. The electric socket convertor provides convenient access to 12-volt D.C. for numerous electrical devices, and obviates permanent electric socket installation.

18 Claims, 2 Drawing Sheets

ELECTRIC SOCKET CONVERTOR

BACKGROUND OF THE INVENTION

1. Field of the Invention

This invention relates to an electric socket convertor. This invention is specifically concerned with a convertor that is receivable into a conventional electric light bulb socket and provides electric power to a portable electric lighter or other portable electric device.

2. Description of the Prior Art

Electric lighter sockets are commonly mounted in automobiles, recreational vehicles, and boats. The sockets are powered by either a 12-volt direct current (D.C.) battery, an alternator, or a generator. An electric lighter is inserted into the socket. Electric current flows from the socket to the electric lighter thereby heating the lighter. Other portable electric devices are also receivable into the socket.

Manufacturers of automobiles, recreational vehicles, and boats do not always provide electric lighter sockets in locations where they are needed. Adapters, connectable to various power sources, have been used to provide 12-volt D.C. to portable electric lighter sockets. Typically, conventional adapters receive power from other electric lighter sockets or from batteries.

U.S. Pat. No. 5,355,273 to Yoshizawa et al. discloses an auxiliary power unit for use with a motor vehicle. A plug is inserted into a cigarette lighter socket provided on the vehicle. A plurality of sockets, electrically connected to the plug by wire, provide current to electrical devices on the vehicle. The plug is not insertable into a conventional electric light bulb socket. Also, none of the sockets provide current to an electric cigarette lighter.

U.S. Pat. No. 2,637,799 to Wood discloses an electric cigar lighter of the removable plug type, and is hereby incorporated by reference. The electric cigar lighter has a lighter plug, a socket, a switch contact for connecting the lighter plug to a terminal, and a mechanism providing for the temperature-controlled opening of the switch contact. The disclosed electric cigar lighter is not insertable into a conventional electric light bulb socket.

U.S. Pat. No. 5,281,158 to Lin discloses a light socket and socket adapter. The socket adapter is inserted into the socket of a decorative light string for the purpose of electrically connecting an electric ornament to the decorative light string. Two opposing contacts on the light socket are short-circuited by a conductive spring when the socket adapter is disconnected. The disclosed socket adaptor is not insertable into a conventional electric light bulb socket.

U.S. Pat. No. 4,248,494 to McDonald et al. discloses an automobile dashboard power adapter. The adapter provides a plurality of electrical power outputs from a single cigarette lighter receptacle. The disclosed adapter is not insertable into a conventional electric light bulb socket.

None of the prior art discloses an electric socket convertor that is receivable into a conventional electric light bulb socket for providing electric power to a portable electric lighter or other portable electric device.

SUMMARY OF THE INVENTION

The principal object of this invention is to provide an electric socket convertor for converting either a 12-volt D.C. or a 120-volt alternating current (A.C.) conventional electric light bulb socket into a source of 12-volt D.C. for portable electric devices, such as cigarette lighters. Another object of the invention is to provide an electric socket convertor that is simple and inexpensive to manufacture. It is also an object of the invention to provide an electric socket convertor that is easy to use, durable, and reliable.

The electric socket convertor for supplying electric current to a portable electrical device, comprises a convertor plug receivable into a conventional electric light bulb socket. An electric convertor socket is connectable with a conventional electric cigarette lighter. A connecting mechanism electrically connects the convertor plug to the convertor socket, such that electric current at the conventional electric light bulb socket is conducted through the convertor plug to the convertor socket.

The electric socket convertor provides for the convenient conversion of a conventional electric light bulb socket into a source of 12-volt D.C. for portable electric devices. The electric socket convertor is simple and inexpensive to manufacture, easy to use, durable, and reliable.

Further objects, details, and advantages of the invention will be apparent from the following detailed description, when read in conjunction with the drawings.

DETAILED DESCRIPTION OF THE INVENTION

Figure 1:
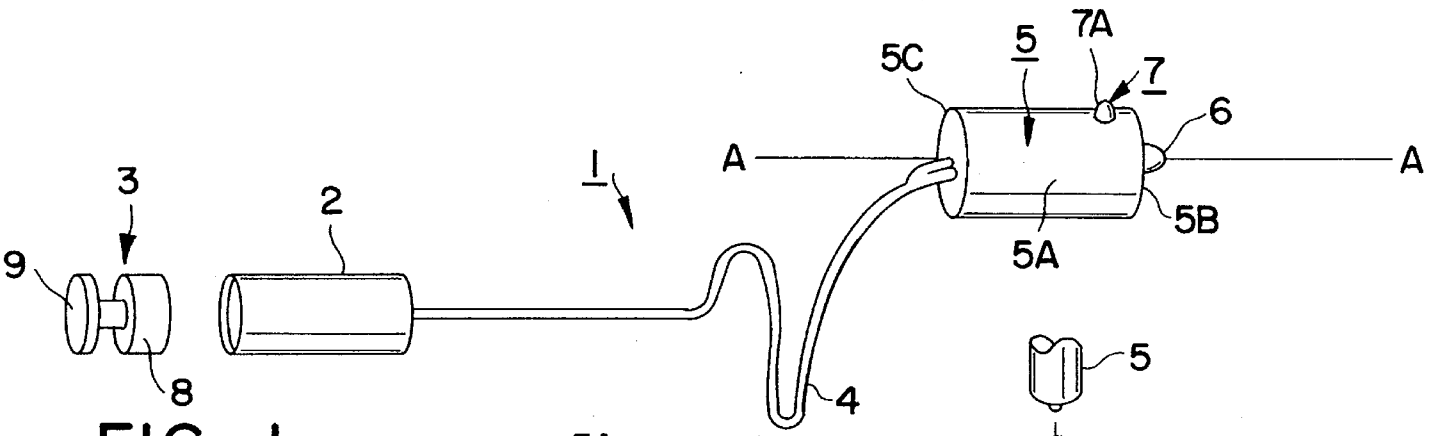
FIG. 1 is a perspective view of the electric socket convertor in accordance with the preferred embodiment of the invention and an electric cigarette lighter.

The electric socket convertor 1 shown in FIG. 1 comprises a convertor female cigarette lighter receptacle 2 and a convertor plug 5. An electric cord 4 connects the convertor female cigarette lighter receptacle 2 to the convertor plug 5.

The cord 4 comprises two insulated wires, each having a proximal and a distal end. The proximal end of both wires are connected to the convertor female cigarette lighter receptacle 2. The distal end of the wires are connected to the convertor plug 5. The electric cord 4 forms an electrical circuit between the convertor female cigarette lighter receptacle 2 and the convertor plug 5.

The convertor plug 5 is receivable into a conventional electric light bulb socket (not shown) of an automobile, recreational vehicle, or boat. The plug 5 has an elongated base 5A, having an axis A along with distal and proximal ends 5B and 5C. An electrically conductive member 6 extends along axis A and projects beyond the distal end 5B of the base 5A. The electrically conductive member 6 is manufactured from material that conducts electricity with nominal resistance, such as copper.

When the conductor plug 5 is inserted into a conventional electric light bulb socket, the electrically conductive member 6 forms a negative electric contact, and the outer surface of the base 5A forms a positive electric contact.

A locking mechanism prevents the convertor plug 5 from moving relative to the conventional electric light bulb socket upon insertion into the conventional electric light bulb socket. The locking mechanism comprises a projection 7 that extends outwardly from the base 5 tangential to the axis A. The projection 7 is received into a slot (not shown) in the conventional electric light bulb socket when the convertor plug 5 is rotated within the conventional electric light bulb socket. The reception of the projection 7 within the slot impedes further movement of the convertor plug within the conventional electric light bulb socket.

A spring (not shown) forces the projection 7 outwardly from the base 5 tangential to the axis A. Downward pressure applied to the projection 7 compresses the spring and pushes projection 7 into base 5A of the convertor plug 5. The proximal end 7A of projection 7 is rounded so that the projection 7 is released from the slot by applying an increased amount of force to rotate the convertor plug 5 within the conventional electric light bulb socket.

The distal end of one wire of cord 4 is connected to the electrically conductive member 6. The distal end of the other wire is connected to the base 5A. When the convertor plug 5 is inserted into a 12-volt D.C. conventional electric light bulb socket, the wire that is connected to the electrically conductive member 6 conducts negative 12-volt D.C. to female cigarette lighter receptacle 2, while the wire that is connected to base 5A conducts positive 12-volt D.C. to female cigarette lighter receptacle 2.

An electric cigarette lighter 3, having a glow element 8 and a handle 9, is insertable into female cigarette lighter receptacle 2. Current passes through glow element 8 when cigarette lighter 3 is inserted into female cigarette lighter receptacle 2. The current passing through glow element 8 encounters resistance, which heats glow element 8. After glow element 8 reaches the desired temperature, the cigarette lighter 3 is automatically ejected from female cigarette lighter receptacle 2 by a mechanism known in the art.

The convertor female cigarette lighter receptacle 2 is also a source of 12-volt D.C. to other portable electric devices, such as portable fans, cellular telephones, car vacuum cleaners, portable televisions, lap top computers, portable video games, and portable radios.

Figure 2:
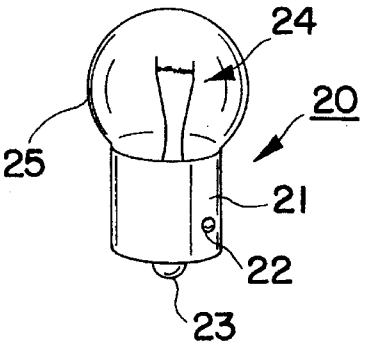
FIG. 2 is a perspective view of a conventional electric light bulb for use with a 12-volt D.C. power supply.

A conventional 12-volt D.C. light bulb 20 is shown in FIG. 2. The light bulb 20 has a base 21, a bulb 25, a light-producing filament 24, and a projection 22. An electrically conductive member 23 and the periphery of the base 21 conduct 12-volt D.C. from the conventional electric light bulb socket to the filament 24. The convertor plug 5 shown in FIG. 1 and the light bulb 20 shown in FIG. 2 are receivable into the same type of electric light bulb socket.

The convertor plug 5 shown in FIG. 1 is also intended for use with electric light bulb sockets that are adapted for various other bulb bases. These bulb bases include, but are not limited to, festoon, mini flanged, mini bayonet, D.C. bayonet, S.C. bayonet, and mini screw.

Figure 3:
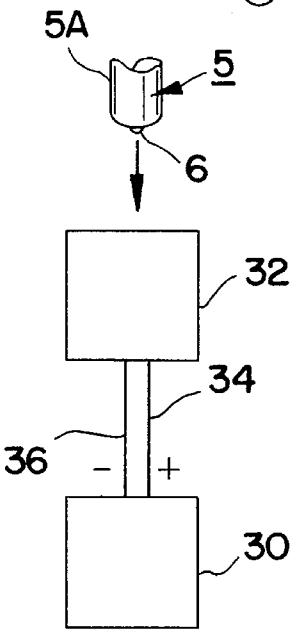
FIG. 3 is a fragmentary perspective view of a convertor plug and a schematic of a 12-volt D.C. circuit for the electric socket convertor.

FIG. 3 illustrates the electrical connection between the convertor plug 5, the conventional electric light bulb socket 32, and the power supply 30. The power supply 30 supplies 12-volt D.C. to the light bulb socket 32 via electric wires 34 and 36. When the plug 5 is inserted into the light bulb socket 32, the electrically conductive member 6 receives negative 12-volt D.C., and the outer surface of base 5A receives positive 12-volt D.C.

Figure 4:
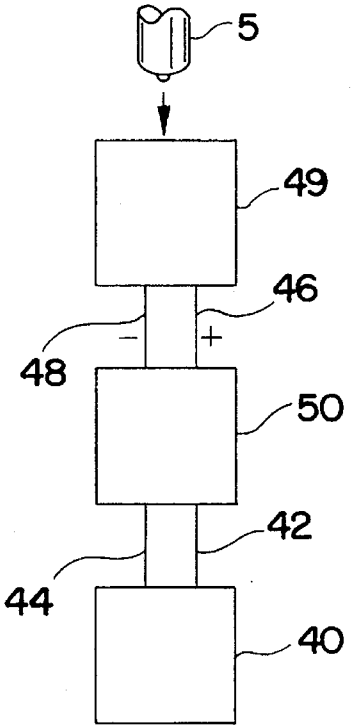
FIG. 4 is a fragmentary perspective view of a convertor plug and a schematic of a 120-volt A.C. circuit for the electric socket convertor.

A second embodiment of the electric socket convertor is shown in FIG. 4. A power source 40 provides 120-volt A.C. to an A.C. to D.C. converter 50 via wires 42 and 44. The A.C. to D.C. converter 50 converts the 120-volt A.C. to 12-volt D.C., and provides 12-volt D.C. to light bulb socket 49 via wires 46 and 48. The convertor plug 50 is received into light bulb socket 49. The electric socket convertor is identical in all other respects to the electric socket convertor of the preferred embodiment.

Figure 5:
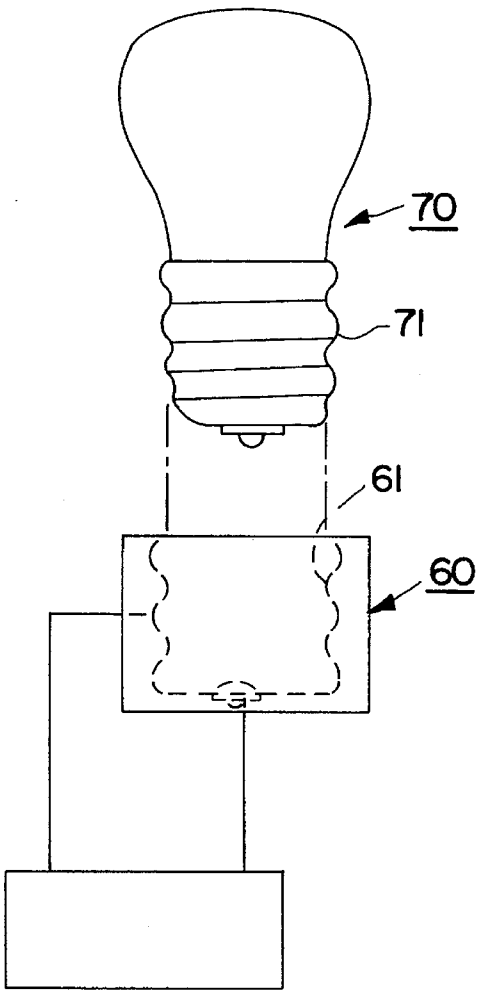
FIG. 5 is a side elevational view of a conventional electric light bulb, a broken-away side elevational view of a conventional electric light bulb socket, and a schematic of an electric circuit for the light bulb and socket.

Another embodiment of the electric socket convertor is illustrated in FIG. 5. A light bulb 70, having a threaded base 71, is insertable into a threaded socket 60 by screwing the light bulb 70 into the socket 60. The threads of the base 71 communicate with the threads 61 of the socket 60 to fasten the light bulb 70 in place. A convertor plug (not shown) having threads similar to those of base 71 would also be receivable into socket 60.

Figure 6:
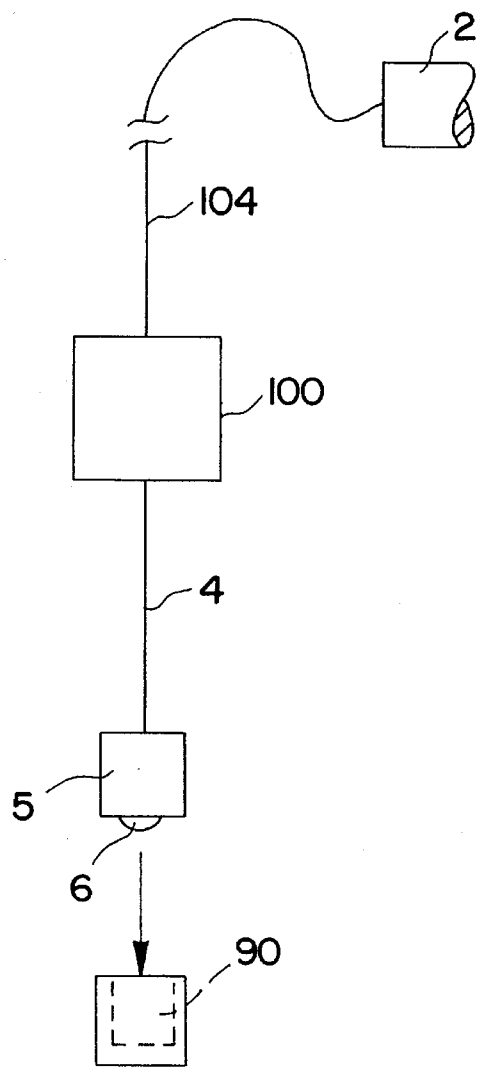
FIG. 6 is a combination perspective and side elevational view of the electric socket convertor, and a schematic of a 120-volt A.C. circuit for the electric socket convertor.

Yet another embodiment of the electric socket convertor is shown in FIG. 6. A conventional electric light bulb socket 90 is supplied with 120-volt A.C. A convertor plug 5 is receivable into the socket 90. An electrically conductive member 6 and the surface of plug 5 conduct 120-volt A.C. to a pair of wires 4. The wires 4 conduct 120-volt A.C. to an A.C. to D.C. converter 100. The A.C. to D.C. convertor 100 converts the 120-volt A.C. to D.C. A second pair of wires 104 conducts the D.C. to the convertor female cigarette lighter receptacle 2.

In the operation of the preferred embodiment of the electric socket convertor 1 shown in FIG. 1, the convertor plug 5 is inserted into a conventional electric light bulb socket. The electric light bulb socket is supplied with 12-volt D.C. The 12-volt D.C. is conducted from the convertor plug 5, through wires 4, to convertor female cigarette lighter receptacle 2. Cigarette lighter 3 is inserted into convertor female cigarette lighter receptacle 2, and current flows through glow element 8. The 12-volt D.C. encounters resistance when flowing through glow element 8, which heats glow element 8. Glow element 8 is ejected from convertor female cigarette lighter receptacle 2 upon reaching an appropriate temperature by an ejection mechanism known in the art.

The electric socket convertor 1 in accordance with the invention conveniently provides a source of power for portable cigarette lighters or other portable electric devices. The electric socket convertor obviates the installation of a permanent electric socket. The electric socket convertor is an alternative to powering portable electric devices by batteries, is easy to use, and utilizes a simple and reliable mechanism.

Various changes can be made to the described embodiments. For example, the electric socket convertor can be manufactured to be water-proof to facilitate use on boats and ships. Also, any number of A.C. to D.C. converters and transformers can be added to facilitate use with various power sources.

Still other modifications, which will occur to persons skilled in the art, may be made without departing from the scope of the invention as defined in the following claims.

I claim:

1. An electric socket convertor for supplying electric current to a portable electrical device comprising:

a convertor plug receivable into a conventional electric light bulb socket;

an electric convertor socket connectable with a conventional electric cigarette lighter; and connecting means for electrically connecting the convertor plug to the convertor socket, such that electric current at the conventional electric light bulb socket is conducted through the convertor plug to the convertor socket.

2. An electric socket convertor according to claim 1, wherein said convertor plug comprises an elongated base having an axis along with proximal and distal ends and an outer surface, and an electrically conductive member which extends along said axis and projects beyond the distal end of said base.

3. An electric socket convertor according to claim 2, wherein the electrically conductive member forms a negative electric contact and the outer surface of the base forms a positive electric contact when the convertor plug is inserted into a conventional electric light bulb socket.

4. An electric socket convertor according to claim 3, wherein said convertor plug further comprises locking means for preventing the convertor plug from moving relative to a conventional electric light bulb socket after said convertor plug is received into said conventional electric light bulb socket.

5. An electric socket convertor according to claim 4, wherein said locking means comprises a projection which extends outwardly from said base tangential to said axis, whereby said projection is received into a slot in a conventional electric light bulb socket when said convertor plug is rotated within said conventional electric light bulb socket, and the reception of said projection within said slot prevents further rotation of said convertor plug within said conventional electric light bulb socket.

6. An electric socket convertor according to claim 5, wherein said connecting means comprises a pair of electrical wires each having a proximal and a distal end, the proximal end of both wires being connected to said convertor socket, the distal end of one wire being connected to the electrically conductive member, and the distal end of the other wire being connected to the base.

7. An electric socket convertor according to claim 1, further comprising an alternating current to direct current electrical converter connected to said convertor plug and said connecting means for converting alternating current from said convertor plug and conveying direct current through said connecting means to said convertor socket.

8. An electric socket convertor according to claim 2, wherein the electrically conductive member forms a positive electric contact and the outer surface of the base forms a negative electric contact when the convertor plug is inserted into a conventional electric light bulb socket.

9. An electric socket convertor according to claim 8, wherein said convertor plug further comprises locking means for preventing the convertor plug from moving relative to a conventional electric light bulb socket after said convertor plug is received into said conventional electric light bulb socket.

10. An electric socket convertor according to claim 9, wherein said locking means comprises a projection which extends outwardly from said base tangential to said axis, whereby said projection is received into a slot in a conventional electric light bulb socket when said convertor is rotated within said conventional electric light bulb socket, and the reception of said projection within said slot prevents further rotation of said convertor within said conventional electric light bulb socket.

11. An electric socket convertor according to claim 10, wherein said connecting means comprises a pair of electrical wires each having a proximal and a distal end, the proximal end of both wires being connected to said convertor socket, the distal end of one wire being connected to the electrically conductive member, and the distal end of the other wire being connected to the base.

12. An electric socket convertor according to claim 11, further comprising an alternating current to direct current electrical converter connected to said convertor plug and said connecting means for converting alternating current from said convertor plug and conveying direct current through said connecting means to said convertor socket.

13. An electric socket convertor according to claim 1, further comprising an alternating current to direct current electrical converter connected to said convertor plug for converting alternating current from a conventional electric light bulb socket and conveying direct current to said convertor plug.

14. An electric socket convertor for supplying electric current to a portable electrical device comprising:

a convertor plug receivable into a conventional electric light bulb socket;

an electric convertor socket connectable with a conventional electric cigarette lighter; and an alternating current to direct current electrical converter connected to said convertor plug and said convertor socket for converting alternating current from said convertor plug and conveying direct current to said convertor socket.

15. An electric socket convertor according to claim 14, wherein said convertor plug comprises an elongated base having an axis along with proximal and distal ends and an outer surface, and an electrically conductive member which extends along said axis and projects beyond the distal end of said base.

16. An electric socket convertor according to claim 15, wherein the electrically conductive member forms a negative electric contact and the outer surface of the base forms a positive electric contact when the convertor plug is inserted into a conventional electric light bulb socket.

17. An electric socket convertor according to claim 16, wherein said convertor plug further comprises locking means for preventing the convertor plug from moving relative to a conventional electric light bulb socket after said convertor plug is received into said conventional electric light bulb socket.

18. An electric socket convertor according to claim 17, wherein said locking means comprises a projection which extends outwardly from said base tangential to said axis, whereby said projection is received into a slot in a conventional electric light bulb socket when said convertor plug is rotated within said conventional electric light bulb socket, and the reception of said projection within said slot prevents further rotation of said convertor plug within said conventional electric light bulb socket.

* * * * *